US005793161A

United States Patent [19]

Peeters et al.

[11] Patent Number: 5,793,161

[45] Date of Patent: Aug. 11, 1998

[54] HIGH-PRESSURE DISCHARGE LAMP ELECTRODE

[75] Inventors: Louis C. A. Peeters; Gilbert Engels, both of Turnhout, Belgium

[73] Assignee: U.S. Philips Corporation, New York, N.Y.

[21] Appl. No.: 431,881

[22] Filed: May 1, 1995

[30] Foreign Application Priority Data

May 3, 1994 [EP] European Pat. Off. ..... 94201231

[51] Int. Cl.[6] ..... H01J 61/06

[52] U.S. Cl. ..... 313/631; 313/628; 313/344; 313/574

[58] Field of Search ..... 313/631, 632, 313/628, 344, 574

[56] References Cited

U.S. PATENT DOCUMENTS 3,170,081 2/1965 Rokosz .

4,275,329 6/1981 Fridrich et al. ..... 313/628

4,783,611 11/1988 Vogels et al. ..... 313/25

5,001,397 3/1991 Der Kinderen ..... 313/628

FOREIGN PATENT DOCUMENTS 1034080 6/1966 United Kingdom .

*Primary Examiner*—Sandra L. O'Shea
*Assistant Examiner*—Joseph Williams
*Attorney, Agent, or Firm*—F. Brice Faller

[57] ABSTRACT

The high pressure discharge lamp has electrodes which each have a wrapping of tungsten wire near the tip of the electrode rod. The electrode rod has unround cross-sections, formed by indentations and bulges. The tungsten wire, wrapped around the electrode rod, is in substantially circumferential contact with the unround cross-sections, thereby keeping the wire fixed to the rod.

5 Claims, 2 Drawing Sheets

HIGH-PRESSURE DISCHARGE LAMP ELECTRODE

BACKGROUND OF THE INVENTION

The invention relates to a high-pressure discharge lamp provided with a discharge vessel which is closed in a vacuumtight manner, which contains an ionizable filling, and into which current conductors enter which are connected to respective electrodes, which electrodes each have a tungsten electrode rod with a tip, and near the tip a wrapping of tungsten wire with turns which are in substantially circumferential contact with the electrode rod.

Such a high-pressure discharge lamp is known from U.S. Pat. No. 5,001,397.

The wire wrapping of the electrode may have the purpose to reduce the electrode temperature during operation compared with the situation in which the wrapping is absent. The electrode has in fact been given a larger heat-radiating surface. Another purpose may be to accommodate an emitter between the turns of the wrapping, for example, in that the electrode was immersed in an emitter suspension, whereby the work function of the electrode is lowered.

The electrode of the known lamp has a wrapping with a first layer of turns of which at least one has a comparatively great pitch, and a second layer of turns provided over the first with a winding direction opposed to that of the first layer. The first and the second layer may be integral, in which case one turn of great pitch is sufficient, or separate, in which case two separate turns of great pitch are present in the first layer.

The first layer of turns together with the electrode rod forms a base surface for the second layer of turns, which surface is unround at the area of a turn of great pitch. It is prevented thereby that the turns of the second layer can lose their tension by sliding tangentially along the first layer. The second layer is thus tensioned around the first layer, and the first layer around the electrode rod. This provides a good heat transfer between the rod and its wrapping.

Another high-pressure discharge lamp of the kind mentioned in the opening paragraph is disclosed in U.S. Pat. No. 4,783,611. The electrode wrapping in this lamp has a similar "knot" for fixation purposes, but the wrapping may also have a third layer of turns which reinforces the fixation of the other layers.

It is a disadvantage of the known electrodes that they have a first and a second layer of turns in order to have a fixed wrapping. Other disadvantages are that the wrapping must be made in a complicated pattern and that it necessarily has a comparatively great length.

Usual is an electrode rod wrapping which was previously manufactured from wire on a special winding mandrel, and which is passed over the electrode rod in this state. The wrapping may consist of two integral layers and may be fastened to the electrode rod by means of a weld or a deformation of a turn.

U.S. Pat. No. 3,170,081 discloses a high-pressure discharge lamp with electrodes which each have a wrapping with a first layer of turns passed over the electrode rod and a second layer of turns passed over the first. The first layer was deformed in the hot state for fixing it on the rod and has a few turns of great pitch between which emitter is applied. The second layer of turns keeps the emitter closed in.

The fixation of a wrapping through welding or local deformation has the disadvantage that it may lead to rejection of lamps or electrodes owing to fracture of the electrode rods. In addition, there will be a varying physical contact from one electrode to the next owing to a variable quality in the fixation, and thus a variable heat transfer, which leads to dispersion in the properties of lamps of one type.

GB-B-1,034,080 discloses a high-pressure discharge lamp whose electrode rods have a flattened zone. Emitter material is provided in the recesses thus created and enclosed by a previously helically wound wire which is pressed around the flattened zone. The wire is in contact with the wide portion of the zone only and clamps itself against this portion. This wrapping has little influence on the temperature of the electrode.

SUMMARY OF THE INVENTION

It is an object of the invention to provide a high-pressure discharge lamp of the kind described in the opening paragraph which has electrodes which are of a universal, simple construction which is readily manufactured.

According to the invention, this object is achieved in that the electrode rod has unround cross-sections with which the wire wrapping is in substantially circumferential contact.

The wrapping must be wound directly onto the electrode rod in order to be in circumferential contact with unround cross-sections. Indeed, a wrapping can only be passed over a rod when the wrapping is wider internally than the rod. A previously wound wire accordingly cannot be in circumferential contact with a round or unround rod. This is even more unthinkable when the rod has cross-sections of varying shape in its longitudinal direction.

Tensions in the wire created by winding cannot relax themselves through tangential shifting of the wire along the rod owing to the unround cross-sections. The unround cross-sections in fact give a turn in the relevant location a changed curvature along the turn. As a result, the turn hooks itself around the rod. The turn essentially retains its initial contact with the rod which was made when the wrapping was manufactured.

The electrode construction is universal because it can be used in electrodes having a single-layer, a dual-layer or a multilayer wrapping, depending on the size and envisaged effect of the wrapping. The first or only layer of turns is in fact already fixed in itself and does not merely serve, as in the known lamp mentioned in the opening paragraph, for creating an unround base surface for a second layer, which must at the same time fix the first layer. The unround cross-section of a turn of the first layer of a winding, however, may in addition serve to fix the next layer of turns.

The rod may be of unround cross-section over its entire length, or over its entire length surrounded by the wrapping, or over only a portion thereof. The unround cross-section may be, for example, oval, square, hexagonal, or substantially rectangular.

In a favourable embodiment, however, the electrode rod has a cylindrical basic shape and therefore round cross-sections. Rods of this shape can be readily manufactured.

Cylindrical rods may have been given unround cross-sections by means of grinding. Because of the manufacturing speed, and because machining and the accompanying pollution are avoided, however, it is favourable when the electrode rod has deformations which supply it with unround cross-sections. No material which was originally present is removed from the rod in the case of deformations, material of the rod has merely been displaced. The electrode rod may, for example, have a profile. The rod may, for example, have been gripped between the jaws of a pair of pliers tangentially to the left and to the right of the rod in cross-section and flattened, so that a wing has been created on the left and on the right of the rod. Alternatively, however, the rod may have been thus deformed at one side only in cross-section. If a rod is indented in diametrically opposed locations in cross-section, for example with a profiled hammer on a profiled anvil, then projections will have been created in this cross-section between the indentations. The result is that comparatively small indentations cause a comparatively great unroundness.

The wrapping may extend over various regions of unround cross-sections, for example over several indentations in the electrode rod, for example two or more, for example from such a region up to another region, possibly covering one or several such regions in between.

The electrode can be easily made. A wire wrapping is provided on the electrode rod from a predetermined location near the tip in that a wire of a given diameter is wound a predetermined number of revolutions around the rod over at least one region of unround cross-section. The electrode is thereby completed. In the manufacture of an electrode having a dual-layer wrapping, the wire may be wound, for example, from a location remote from the rod tip around the rod towards the tip. When arriving at a predetermined distance from the tip, possibly beyond the tip, the wire can then be wound back over the first layer of turns obtained up to a predetermined distance from the tip, for example with the same pitch as the first layer of turns, for example with a pitch equal to the wire diameter. The electrode has thus been completed.

In a favourable embodiment, the electrode rod is provided with a symmetrical pattern of regions of unround cross-section, for example with indentations. The advantage of this is that the two rod ends are identical and that no distinction need be made between the tip of the rod and its other end during manufacture of the wrapping.

The measure according to the invention is particularly suitable for lamps of comparatively low power, for example of 100 W or less, because these have comparatively small electrodes with comparatively thin electrode rods, for example with a diameter of 150–700 μm, and with a wire wrapping of, for example, 50–300 μm diameter. The ratio between the rod diameter and the wire diameter, however, is $\geqq 1.3$ then. A helically wound wire of such diameter for a rod of such diameter is difficult to handle if the wound wire were to be assembled with the rod. Such a wire is also particularly vulnerable if it has to be flattened or welded in order to fix it into place.

The ionizable filling may comprise besides a rare gas, for example, mercury, possibly with sodium or metal halides. The discharge vessel may be, for example, of quartz glass or ceramic material, for example of monocrystalline or polycrystalline aluminium oxide.

The discharge vessel may be arranged in an outer envelope, which may be filled with gas, and which may have a lamp cap.

BRIEF DESCRIPTION OF THE DRAWINGS

An embodiment of the high-pressure discharge lamp according to the invention is shown in the drawing, in which.

DESCRIPTION OF THE PREFERRED EMBODIMENTS

Figure 1:
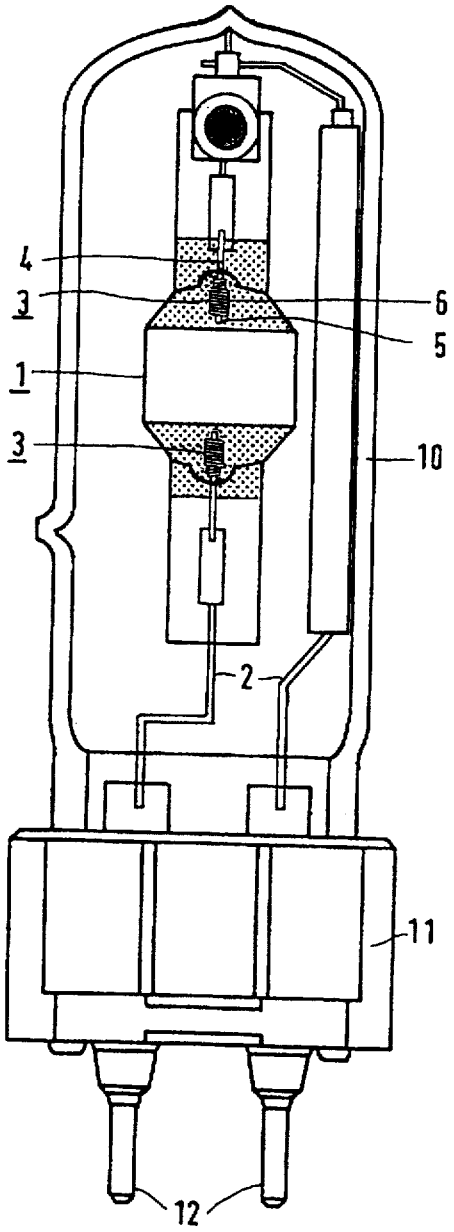
FIG. 1 shows a high-pressure discharge lamp in side elevation.

In FIG. 1, the high-pressure discharge lamp has a discharge vessel 1, made of quartz glass in the Figure, which is closed in a vacuumtight manner and which contains an ionizable filling, with argon/krypton as a starting gas, metal iodides, and mercury as a buffer gas in the Figure. Current conductors 2 enter the discharge vessel. They are each connected to a respective electrode 3. The electrodes each have a tungsten electrode rod 4 with a tip 5 and, adjacent the tip, a wrapping 6 of tungsten wire with turns which are in substantially circumferential contact with the electrode rod.

The electrode rod 4 (see FIGS. 3, 4) has unround cross-sections with which the wrapping 6 of tungsten wire is in substantially circumferential contact.

The electrodes 3 have a wrapping 6 of tungsten wire with a first layer of turns directly on the electrode rod 4, which layer merges into a second layer of turns near the tip 5, the second layer being arranged over the first one.

The lamp shown has an outer envelope 10, made of quartz glass in the Figure, to which a lamp cap 11 provided with contacts 12 is fastened. The contacts are connected to respective current conductors 2.

Figure 2:
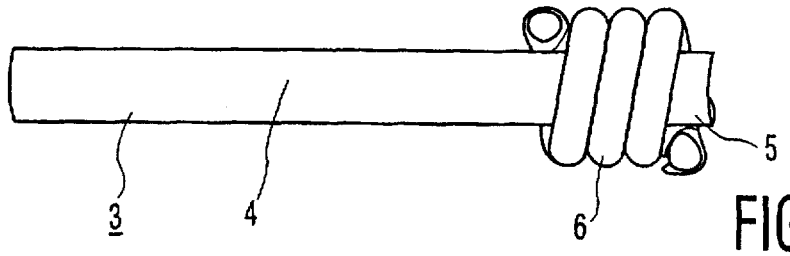
FIG. 2 is a side elevation of an electrode other than the one in FIG. 1.
Figure 3:
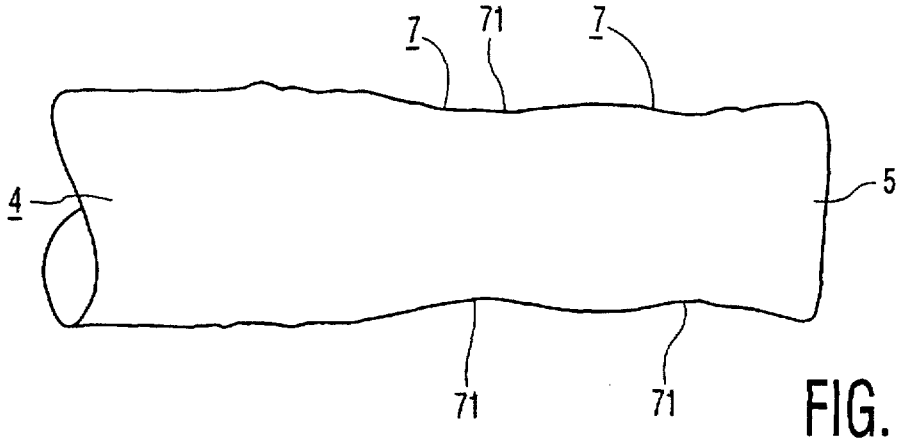
FIG. 3 is the side elevation of the electrode rod of FIG. 2.
Figure 4:
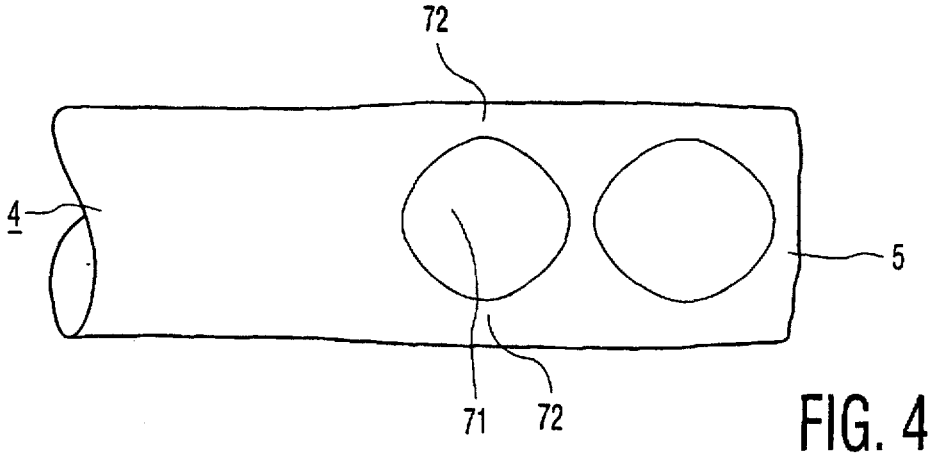
FIG. 4 is the side elevation of the electrode rod taken on IV in FIG. 3.

In FIGS. 2–4, the electrode rod 4 shown has a cylindrical basic shape of 308 μm diameter and deformations 7 at the areas of the unround cross-sections.

The electrode has a wrapping 6 of three turns of tungsten wire of 170 μm diameter. The wrapping extends over two deformations and is thus fixed on the rod. FIG. 2 shows the differences in diameter of the turns owing to the electrode rod deformations. The electrode shown may be used, for example, in a lamp which consumes a power of 70 W. The wrapping is fixed on the electrode rod by the mere fact that the wire was wound directly around the rod of FIGS. 3 and 4.

FIG. 4 shows that the electrode rod 4 has diametrically opposed bulges 72 between the diametrically opposed indentations 71 (FIG. 3).

Figure 5:
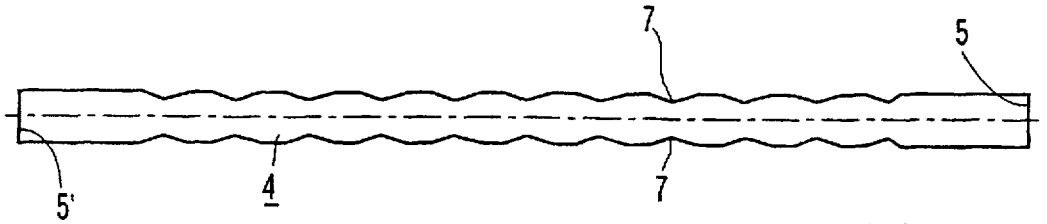
FIG. 5 shows an alternative electrode rod in side elevation.

In FIG. 5, the electrode rod 4 has a symmetrical pattern of deformations 7 so that the electrode tip 5 is equivalent to the other end 5' before the wrapping is provided. The rod has a basic shape of 170 μm diameter and may be wrapped around with tungsten wire of 125 μm so as to be used in a 35 W lamp.

We claim:

1. A high-pressure discharge lamp which comprises:

a discharge vessel which is closed in a vacuumtight manner, which contains an ionizable filling;

current conductors which enter the discharge vessel;

electrodes which are connected to the respective current conductors, the electrodes each comprising a tungsten electrode rod with a tip; and a wrapping of tungsten wire near the tip having turns which are in substantially circumferential contact with the electrode rod, characterized in that: the electrode rod has unround cross-sections with which the wire wrapping is in substantially circumferential contact.

2. A high-pressure discharge lamp as claimed in claim 1, characterized in that the electrode rod has a cylindrical basic shape and has deformations at the areas of the unround cross-sections.

3. A high-pressure discharge lamp as claimed in claim 2, characterized in that the electrode rod in cross-section has diametrically opposed indentations, with bulges in between said indentations.

4. A high-pressure discharge lamp as claimed in claim 3, characterized in that the electrode rod has a symmetrical pattern of deformations.

5. A high-pressure discharge lamp as claimed in claim 2, characterized in that the electrode rod has a symmetrical pattern of deformations.

* * * * *